US012467701B2

(12) United States Patent
Wungkahard et al.

(10) Patent No.: US 12,467,701 B2
(45) Date of Patent: Nov. 11, 2025

(54) HEAT EXCHANGER

(71) Applicant: VALEO SYSTEMES THERMIQUES, La Verriere (FR)

(72) Inventors: Supawadee Wungkahard, Chon Buri (TH); Jaturong Choeinam, Chon Buri (TH); Poonsin Sratonghoi, Chon Buri (TH)

(73) Assignee: VALEO SYSTEMES THERMIQUES, La Verriere (FR)

( * ) Notice: Subject to any disclaimer, the term of this patent is extended or adjusted under 35 U.S.C. 154(b) by 289 days.

(21) Appl. No.: 17/999,252

(22) PCT Filed: Apr. 19, 2021

(86) PCT No.: PCT/EP2021/060046
§ 371 (c)(1),
(2) Date: Nov. 18, 2022

(87) PCT Pub. No.: WO2021/239330
PCT Pub. Date: Dec. 2, 2021

(65) Prior Publication Data

US 2023/0213292 A1 Jul. 6, 2023

(30) Foreign Application Priority Data

May 26, 2020 (EP) ..... 20176526

(51) Int. Cl.
*F28F 9/00* (2006.01)
*F28F 9/02* (2006.01)

(52) U.S. Cl.
CPC ..... *F28F 9/001* (2013.01); *F28F 9/02* (2013.01); *F28F 2009/0292* (2013.01)

(58) Field of Classification Search
CPC ..... F28F 9/001; F28F 9/02; F28F 2009/0292; F28F 2230/00; F28F 2265/02
See application file for complete search history.

(56) References Cited

U.S. PATENT DOCUMENTS 4,876,778 A 10/1989 Hagihara et al.
5,667,004 A * 9/1997 Kroetsch ..... F28F 9/001 165/41

(Continued)

FOREIGN PATENT DOCUMENTS

EP 1500892 A2 1/2005
EP 1522814 A2 4/2005
FR 2902506 A1 12/2007

OTHER PUBLICATIONS

European Patent Office, International Search Report and Written Opinion of corresponding International Application No. PCT/EP2021/060046, dated Jun. 25, 2021.

(Continued)

*Primary Examiner* — Travis Ruby
(74) *Attorney, Agent, or Firm* — Osha Bergman Watanabe & Burton LLP

(57) ABSTRACT

A heat exchanger includes a tank, spaced apart tubular elements, fins and a side cover. The tank receives a first heat exchange fluid therein. The spaced apart tubular elements defining a heat exchanger core are in fluid communication with the tank and enable heat exchange between a first heat exchange fluid flowing there through and a second heat exchange fluid flowing around and across the tubular elements. The fins arranged alternately with respect to the tubular elements promote heat exchange. The side cover adjacent to a lateral face of the heat exchanger core, covers and shields the lateral face and at least a portion of the heat exchanger core disposed between the tubular elements proximal to the lateral face of the heat exchanger core and the corresponding side cover.

11 Claims, 7 Drawing Sheets

(56) References Cited

U.S. PATENT DOCUMENTS

| | | | | |
|---|---|---|---|---|
| 5,853,046 | A * | 12/1998 | Williams | B60H 1/00521 277/637 |
| 6,105,668 | A * | 8/2000 | Schwarz | F28F 9/001 123/196 AB |
| 6,182,745 | B1 * | 2/2001 | Potier | F28F 1/32 165/149 |
| 7,032,656 | B2 | 4/2006 | Lamich | |
| 2002/0174975 | A1 * | 11/2002 | Birkholz | F28D 1/0478 165/149 |
| 2005/0016717 | A1 | 1/2005 | Lamich et al. | |
| 2010/0218914 | A1 | 9/2010 | Irmler et al. | |
| 2014/0014307 | A1 | 1/2014 | Richardson et al. | |

OTHER PUBLICATIONS

European Patent Office, Office Action of corresponding Application No. EP20176526.0, dated Nov. 3, 2022 . . . .

* cited by examiner

HEAT EXCHANGER

TECHNICAL FIELD

The present invention relates to a heat exchanger for a vehicle, more particularly, the present invention relates to vehicle heat exchanger with a side cover.

BACKGROUND OF THE INVENTION

A heat exchanger known in the art includes at least one tank, a plurality of spaced apart tubular elements, a plurality of fins and at least one side cover. Preferably, the heat exchanger includes an inlet tank and an outlet tank. The inlet tank is in fluid communication with an inlet pipe for ingress of a first heat exchange fluid therein. The tubular elements connect the inlet tank and the outlet tank and configure fluid communication between the inlet tank and the outlet tank. The tubular elements are spaced apart from each other with fins disposed between the adjacent tubular elements to define a heat exchanger core. The first heat exchange fluid received in the inlet tank flows through the tubular elements and undergoes heat exchange with a second heat exchange fluid flowing around and across the tubular elements as the first heat exchange fluid flows through the tubular elements. The fins disposed next to the tubular elements enhance turbulence in the second heat exchange fluid around the tubular elements and improve the surface contact between the second heat exchange fluid and the tubular elements. The first heat exchange fluid after passing through the tubular elements and after undergoing heat exchange is collected in the second tank. The second tank is in fluid communication with an outlet pipe for egress of the first heat exchange collected in the second tank after the first heat exchange fluid had undergone heat exchange by passing through the tubular elements.

The tubular elements at the extreme ends of the heat exchanger core, particularly, the tubular elements disposed along lateral faces of the heat exchanger core can provide limited contribution to the heat exchange and the heat exchanger efficiency as the tubular element farthest from the inlet pipe can fail to receive sufficient first heat exchange fluid therein. Sometimes the tubular elements at the extreme ends of the heat exchanger core function as the side plates and there is no flow of the first heat exchange fluid through such tubular elements. Considering the above, the tubular elements at the extreme ends of the heat exchanger are dummy tubular elements as there is either no flow or limited flow of the first heat exchange fluid through such tubular elements at the extreme ends of the heat exchanger. Further, the fins at the extreme ends of the heat exchanger is in contact with and extract heat from a single tubular element adjacent thereto and on the side thereof facing the interior of the heat exchanger core whereas the other fins are sandwiched between and extract heat from two adjacent tubular elements. Accordingly, the fins at the extreme ends of the heat exchanger exhibit comparatively reduced heat extraction capacity compared to other fins sandwiched between adjacent tubular elements. Considering the above, the fins at the extreme ends of the heat exchanger are also not contributing fully to the heat exchange and heat exchanger efficiency. Accordingly, the flow of the second heat exchange fluid across the fins disposed between the tubular elements at the extreme ends of the heat exchanger core and the side cover is not contributing fully to the heat exchange or the heat exchange efficiency. The flow of the second heat exchange fluid across the fins disposed next the tubular elements at the extreme ends of the heat exchanger core and the side cover can be detrimental for the efficiency and performance of the heat exchanger. Additionally, the arrangement of the side plate with respect to the tank, e.g. its header, can be imperfect and lead to leaks of the second heat exchange fluid, i.e. air there-between.

Accordingly, there is a need for a side cover that not only performs its function of covering and shielding a lateral face of a heat exchanger, particularly, a heat exchanger core but also contributes in improving efficiency and performance of the heat exchanger by regulating fluid flow of a second heat exchange fluid across at least a portion of the heat exchanger core.

BRIEF SUMMARY OF THE INVENTION

An object of the present invention is to provide a side cover that not only performs its function of covering and shielding a lateral face of a heat exchanger but also contributes in improving efficiency and performance of the heat exchanger.

Another object of the present invention is to provide a side cover that is simple in construction and efficient in regulating fluid flow of a second heat exchange fluid across at least a portion of the heat exchanger core to improve efficiency and performance of the heat exchanger.

Still another object of the present invention is to provide a side cover that is easy and convenient to assemble on the heat exchanger.

In the present description, some elements or parameters can be indexed, such as a first element and a second element. In this case, unless stated otherwise, this indexation is only meant to differentiate and name elements which are similar but not identical. No idea of priority should be inferred from such indexation, as these terms can be switched without betraying the invention. Additionally, this indexation does not imply any order in mounting or use of the elements of the invention.

A heat exchanger is disclosed in accordance with an embodiment of the present invention. The heat exchanger includes a tank, a plurality of spaced apart tubular elements, a plurality of fins and a side cover. The tank receives a first heat exchange fluid therein. The plurality of spaced apart tubular elements are in fluid communication with the tank to enable heat exchange between a first heat exchange fluid flowing there through and a second heat exchange fluid flowing around and across the tubular elements. The plurality of fins are arranged alternately with respect to the tubular elements, the fins promote heat exchange between the first heat exchange fluid and the second heat exchange fluid. The first and the last of the fins constituting respectively opposite lateral faces of the heat exchanger core. The side cover is adjacent to a lateral face of the heat exchanger core. The side cover covers and shields at least one corresponding lateral face of the heat exchanger core and at least a portion of the heat exchanger core disposed between the tubular elements proximal to the lateral face of the heat exchanger core and the corresponding side cover.

Specifically, the at least one side cover includes a side panel and tabs. The side panel is complimentary to and aligned with respect to a corresponding lateral face of the heat exchanger core. The tabs are configured on at least one of the opposite lateral sides of the side panel. The tabs are orthogonal to the side panel and covers at least a portion of the fins disposed between the tubular element proximal to the lateral face of the heat exchanger core and the corresponding side panel.

In accordance with an embodiment, a plurality of tabs configured on at least one of the opposite sides of the side panel are spaced away from each other with gap in between adjacent tabs.

Alternatively, a single continuous tab is configured on at least one of the opposite sides of the side panel.

Further, the tabs formed on extreme ends of at least one of the opposite sides of the side panel are abutting the respective at least one tank.

Generally, the tabs extend from the side panel to at least up to the tubular element proximal to the corresponding lateral face of the heat exchanger core.

Alternatively, the tabs extend from the side panel and beyond the tubular element proximal to the corresponding lateral face of the heat exchanger core.

Generally, the side cover is of metal and is formed by stamping and bending.

More specifically, the side cover is of aluminum and is directly brazed to the fins.

Generally, the tubular element proximal to the lateral face of the heat exchanger core and the corresponding side cover is spaced less than or equal to pitch between the adjacent tubular elements.

Preferably, the tank is wider than the side cover, the side cover is wider than the heat exchanger core for accommodating an insulating material between the side cover and the heat exchanger core.

Generally, the side panel is overlapping the corresponding header.

Alternatively, the side cover is of plastic and is formed by molding.

Generally, the side cover is secured to the heat exchanger core.

Alternatively, the at least one side cover is removably mounted on the heat exchanger core.

BRIEF DESCRIPTION OF THE DRAWINGS

Other characteristics, details and advantages of the invention can be inferred from the description of the invention hereunder. A more complete appreciation of the invention and many of the attendant advantages thereof will be readily obtained as the same becomes better understood by reference to the following detailed description when considered in connection with the accompanying figures, wherein.

DETAILED DESCRIPTION OF THE INVENTION

It must be noted that the figures disclose the invention in a detailed enough way to be implemented, said figures helping to better define the invention if needs be. The invention should however not be limited to the embodiment disclosed in the description.

Although the present invention is explained in the forthcoming description and the accompanying drawings with an example of a radiator for use in a vehicle, the present invention is also applicable for any heat exchanger for use in a vehicle, wherein it is required to regulate fluid flow of second heat exchange fluid across at least a portion of a heat exchanger core in order to enhance efficiency and performance of the heat exchanger.

Figure 1:
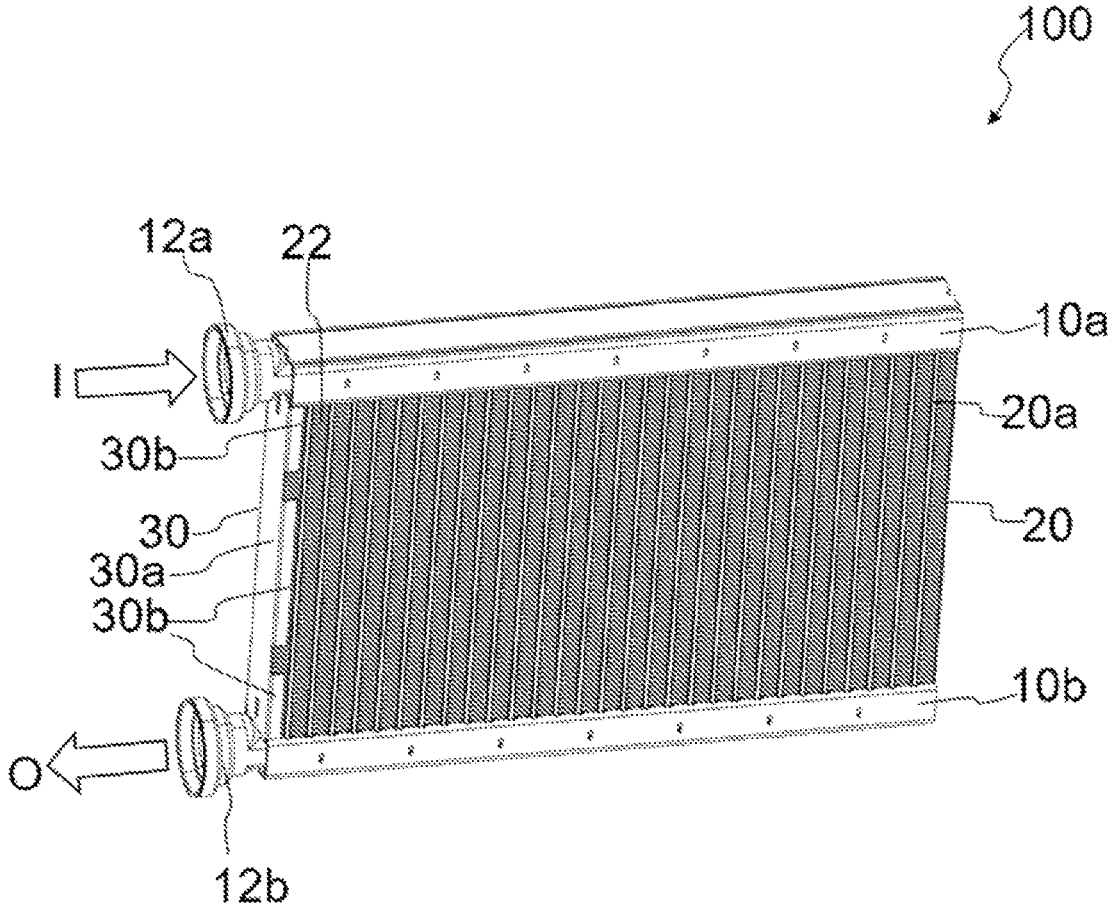
FIG. 1 illustrates an isometric view of a heat exchanger in accordance with an embodiment of the present invention.
Figure 2A:
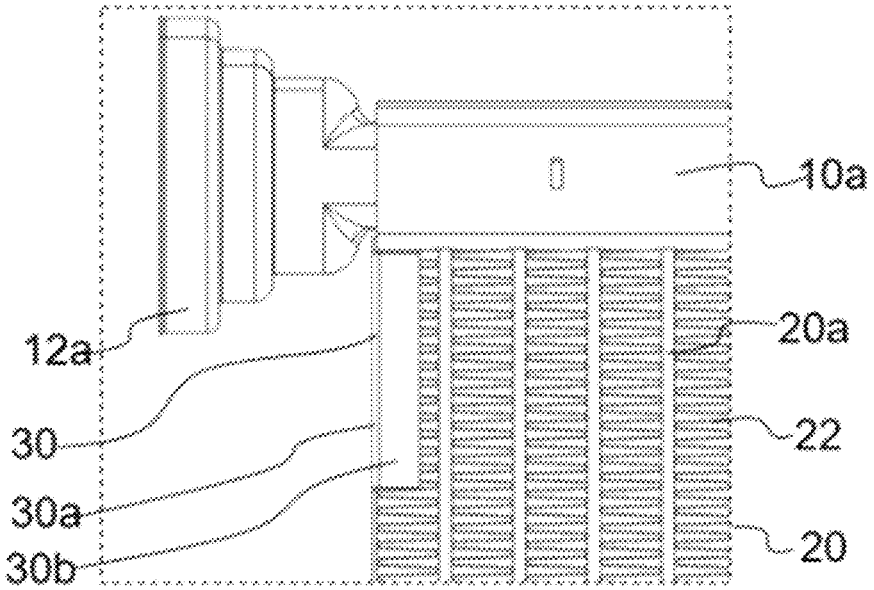
FIG. 2*a* illustrates an enlarged view of a portion of the heat exchanger of FIG. 1, wherein at least a portion of fins disposed between a tubular element at an extreme end of a heat exchanger core and a side panel of a side cover are covered by a tab orthogonally extending from a side panel.
Figure 2B:
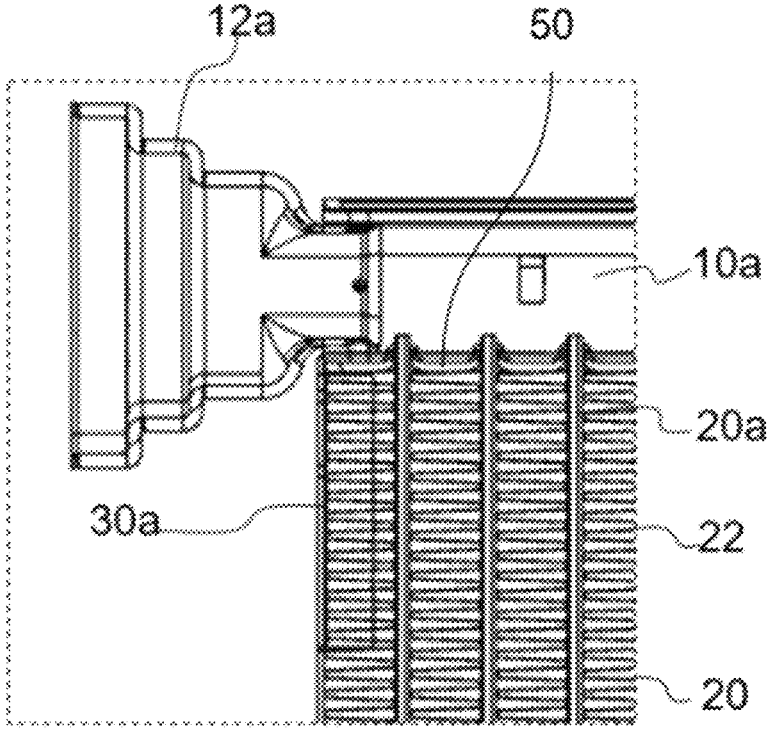
FIG. 2*b* illustrates a sectional view of the portion of the heat exchanger of FIG. 2*a;*
Figure 3:
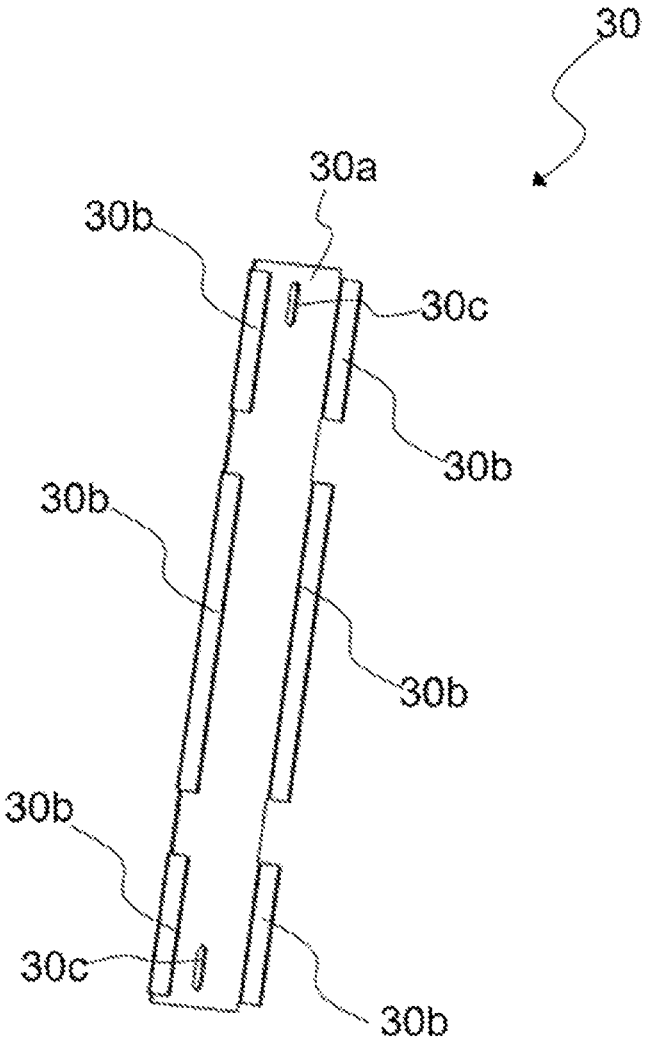
FIG. 3 illustrates an isometric view of the side cover of FIG. 2*a;*
Figure 4:
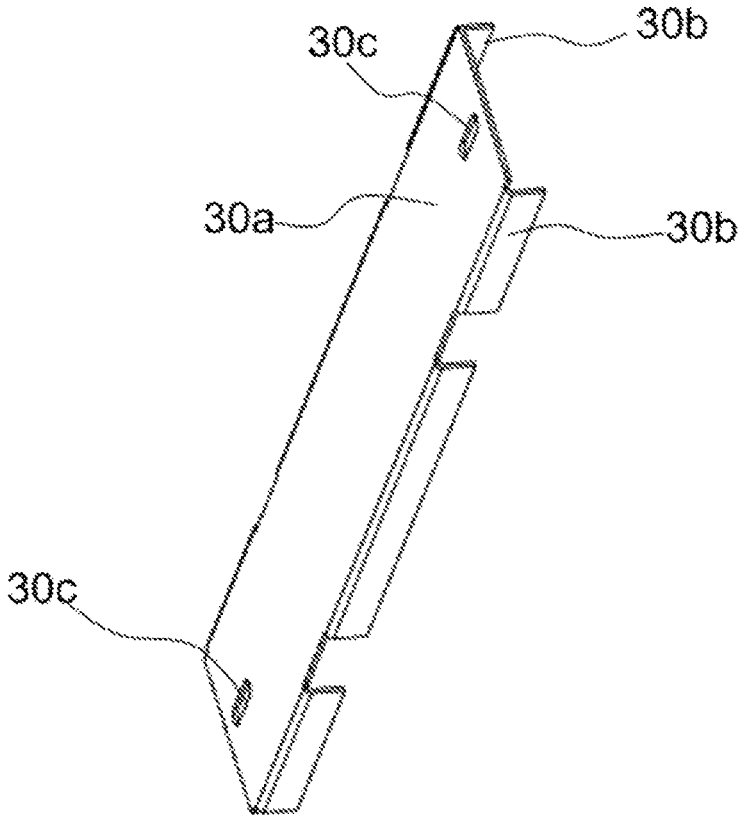
FIG. 4 illustrates another isometric view of the side cover of FIG. 2*a;*

FIG. 1 illustrates an isometric view of a heat exchanger 100, for example a radiator in accordance with an embodiment of the present invention. The heat exchanger 100 includes at least one tank 10*a*, 10*b*, a plurality of spaced apart tubular elements 20*a*, a plurality of fins 22 and a side cover 30. The at least one tank 10*a*, 10*b* receives a first heat exchange fluid therein. The plurality of spaced apart tubular elements 20*a* are in fluid communication with the at least one tank 10*a*, 10*b* to at least one of receive the first heat exchange fluid therefrom and deliver the first heat exchange fluid thereto. More specifically, the heat exchanger 100 includes an inlet tank 10*a* and an outlet tank 10*b*. The inlet tank 10*a* is in fluid communication with an inlet pipe 12*a* for ingress of a first heat exchange fluid therein depicted by arrow "I". The tubular elements 20*a* connect the inlet tank 10*a* and the outlet tank 10*b* and configure fluid communication between the inlet tank 10*a* and the outlet tank 10*b*. The tubular elements 20*a* are spaced apart from each other. The spacing between the tubular element 20*a* proximal to the lateral face of the heat exchanger core 20 and the corresponding side cover 30 can be less than or equal to pitch between the adjacent tubular elements 20*a*. The tubular elements 20*a* and the fins 22 are disposed alternately to each other to define a heat exchanger core 20. The first and the last of the fins 22 constitute respective opposite lateral face of the heat exchanger core 20. The first heat exchange fluid is received in the inlet tank 10*a*. The tubular elements 20*a* receive the first heat exchange fluid from the inlet tank 10*a*. As the first heat exchange fluid flows through the tubular elements 20*a*, the first heat exchange fluid undergoes heat exchange with a second heat exchange fluid flowing around and across the tubular elements 20*a*. The fins 22 disposed around the tubular elements 20*a* enhance turbulence in the second heat exchange fluid across and around the tubular elements 20*a* and improve the surface contact between the second heat exchange fluid and the tubular elements 20*a*. The first heat exchange fluid after passing through the tubular elements 20*a* is delivered to the outlet tank 10*b*. The outlet tank 10*b* is in fluid communication with an outlet pipe 12*b* for egress of the first heat exchange collected in the outlet tank 10*b* after the first heat exchange fluid had undergone heat exchange by passing through the tubular elements 20*a*. The egress of the first heat exchange fluid through the second tank is depicted by arrow "O".

Figure 5:
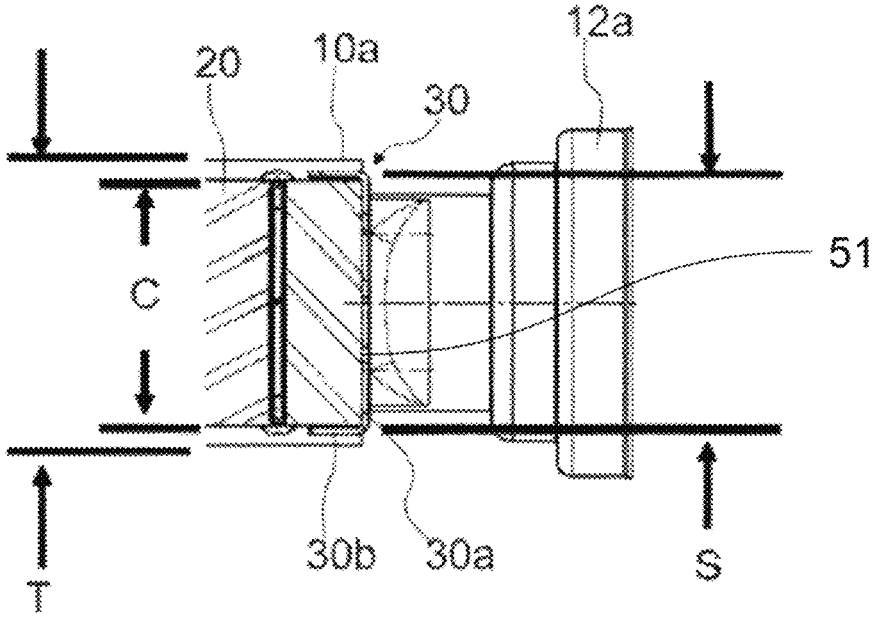
FIG. 5 illustrates an enlarged view depicting assembly between a tank, a side cover and the heat exchanger core of the heat exchanger of FIG. 1.

The side cover 30, covers corresponding lateral face of the heat exchanger 100, particularly, the heat exchanger core 20. Generally, the tank 10*a*, 10*b* is wider than the side cover 30. Referring to the FIG. 5, width of the tank 10*a*, 10*b* is represented by "T", the width of the side plate 30 is represented by "S" and the width of the heat exchanger core 20 is represented by "C". Generally, the inter-relation between the width "T" of the tank 10*a*, 10*b*, the width "S" of the side plate 30 and the width "C" of the heat exchanger core 20 is C<S<T. The side cover 30 is wider than the heat exchanger core 20 to accommodate an insulating material 51 between the side cover 30 and the heat exchanger core 20. Generally, the insulating material 51 disposed between the side cover 30 and lateral side of the heat exchanger core 20 is foam. The gap between the tank 10*a*, 10*b* and the side cover 30 is also filled with material to prevent leakage there through. Apart from performing its regular function of covering and shielding the corresponding lateral face of the heat exchanger 100, the side cover 30 also covers at least a portion of the heat exchanger core 20 disposed between the tubular element 20*a* that is proximal to the lateral face of the heat exchanger core 20 and the corresponding side cover 30. More specifically, the side cover 30 covers and shields the fins 22 disposed between the tubular element 20*a* proximal to the lateral face of the heat exchanger core 20 and the corresponding side cover 30 to prevent flow of a second heat exchange fluid across the fins 22. With such configuration of the side cover 30, the side cover 30 regulates fluid flow of the second heat exchange fluid across the heat exchanger core 20, thereby improving efficiency and performance of the heat exchanger 100.

Generally, the side cover 30 is of metal and is formed by stamping and bending. Alternatively, the side cover 30 can be of plastic and be formed by molding. The side cover 30 is secured to the heat exchanger core 20. More specifically, the side cover 30 is of aluminum and is directly brazed to the fins 22. Alternatively, the side cover 30 is removably mounted on the heat exchanger core 20. For example, snap fit engagement elements formed on the side cover 30 and the heat exchanger core 20 enables removable mounting of the side cover 30 on the lateral face of the heat exchanger 100. The side cover 30 can be formed of any material and any process and the side cover 30 can be mounted or secured to the heat exchanger 100 using any arrangement as far as the side cover 30 is capable of covering and shielding the corresponding lateral face of the heat exchanger 100 and cover at least the portion of the fins 22 disposed between the tubular 20*a* proximal to the lateral face of the heat exchanger core 20 and the at least one corresponding side cover 30.

Figure 8:
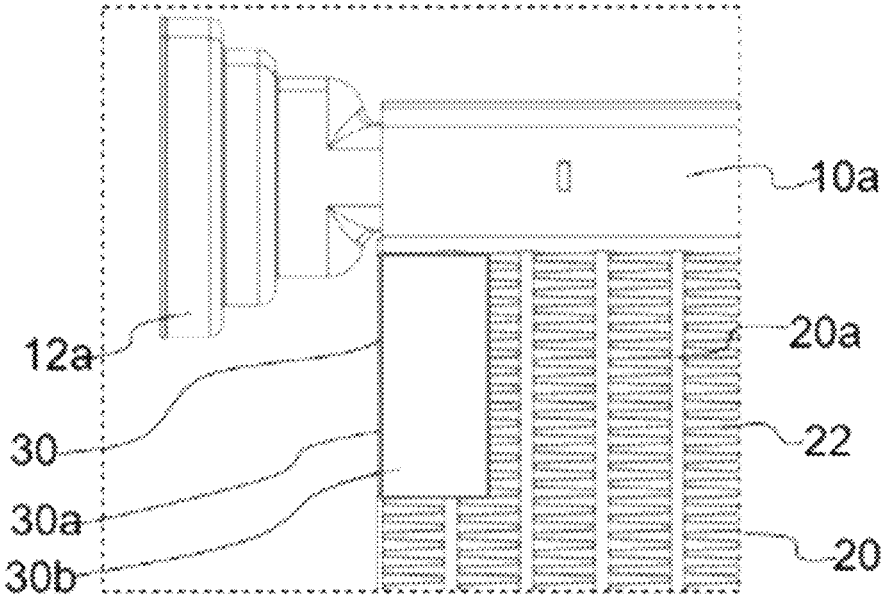
FIG. 8 illustrates a sectional view of the portion of the heat exchanger of FIG. 2*a*, wherein the side panel is overlapping the corresponding header.

Generally, the side cover 30 includes a side panel 30*a* and at least one tab 30*b* configured on at least one of the opposite sides of the side panel 30*a*. In one example, the side cover 30 is of U-shaped configuration with the tabs 30*b* orthogonally formed on the side panel 30*a* covering at least a portion of the heat exchanger core 20 from front as well as rear. With such configuration, the tabs 30*b* on the opposite sides of the side cover 30 can interchangeably cover front face of at least a portion of the heat exchanger core 20. Alternatively, the tabs 30*b* are configured on only one side of the side panel 30*a*. With such configuration, the side cover 30 is so arranged with respect to the heat exchanger core 20 that the tabs 30*b* orthogonally extending from one side of the side panel 30*a* covers front face of at least a portion of the heat exchanger core 20. The side panel 30*a* is complimentary to and aligned with respect to a corresponding lateral face of the heat exchanger 100, particularly, the heat exchanger core 20 to cover the lateral face of the heat exchanger 100. The side panel 30*a* further includes ends apertures 30*c* configured thereon, particularly near opposite extreme ends thereof. The side panel 30*a* can be of laminar configuration or a curved configuration. The side panel 30*a* is capable of covering and shielding the lateral face of the heat exchanger 100, particularly, the heat exchanger core 20. Generally, the tabs 30*b* formed on extreme ends of the opposite sides of the side panel 30*a* are either overlapping over or abutting the respective tank 10*a*, 10*b*. More specifically, the tabs 30*b* formed on the extreme end or top end of the opposite sides of the side panel 30*a* proximal to the inlet tank 10*a* are abutting the inlet tank 10*a*. Similarly, the tabs 30*b* formed on the extreme end or bottom end of the opposite sides of the side panel 30*a* proximal to the outlet tank 10*b* are abutting the outlet tank 10*b*. More specifically, the tabs 30*b* at the extreme ends of the side panel 30*a* are abutting against the respective inlet tank 10*a* and the outlet tank 10*b*. In some cases, the side panel 30*a* are overlapping over and/or abutting the respective headers 50 to prevent air leakage through any gap between header 50 and respective side panel 30*a*, as shown in FIG. 8.

Figure 7:
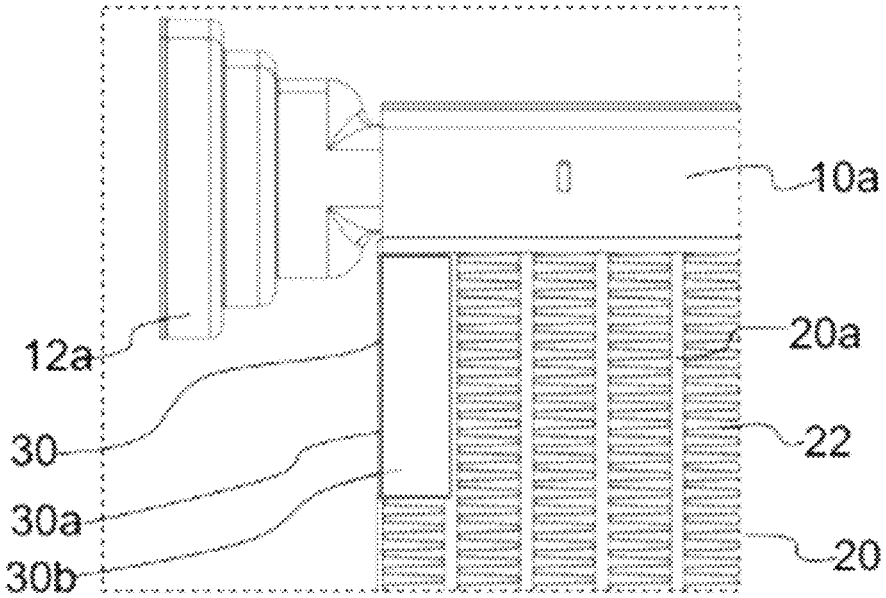
FIG. 7 illustrates a sectional view of the portion of the heat exchanger of FIG. 2*a*, wherein the tabs extend from the side panel at least up to the tubular element proximal to the corresponding lateral face of the heat exchanger core.

The tabs 30*b* configured on each of the opposite lateral sides of the side panel 30*a* is orthogonal to the side panel 30*a* and covers at least a portion of the heat exchanger core 20 disposed between the tubular element 20*a* proximal to the lateral face of the heat exchanger 100, particularly, the heat exchanger core 20 and the corresponding side panel 30*a*. More specifically, the tabs 30*b* configured on each of the opposite sides of the side panel 30*a* covers at least the portion of the fins 22 disposed between the tubular element 20*a* proximal to the lateral face of the heat exchanger 100, particularly, the heat exchanger core 20 and the corresponding side panel 30*a*. The tabs 30*b* extend from the side panel 30*a* to at least up to the tubular element 20*a* proximal to the corresponding lateral face of the heat exchanger 100, particularly, the heat exchange core 20, as shown in FIG. 7. In one example, the tabs 30*b* extend from the side panel 30*a* to just before the tubular element 20*a* proximal to the corresponding lateral face of the heat exchanger 100, particularly, the heat exchanger core 20. In another example, the tabs 30*b* extend from the side panel 30*a* to the tubular element 20*a* proximal to the corresponding lateral face of the heat exchanger 100, particularly, the heat exchanger core 20. Alternatively, the tabs 30*b* extend from the side panel 30*a* to beyond the tubular element 20*a* proximal to the lateral face of the heat exchanger 100, particularly, the heat exchanger core 20. In case the last tubular element functions as the side cover, the tabs orthogonally extend from the last tubular element and extend at least up to the penultimate tubular element.

Figure 6:
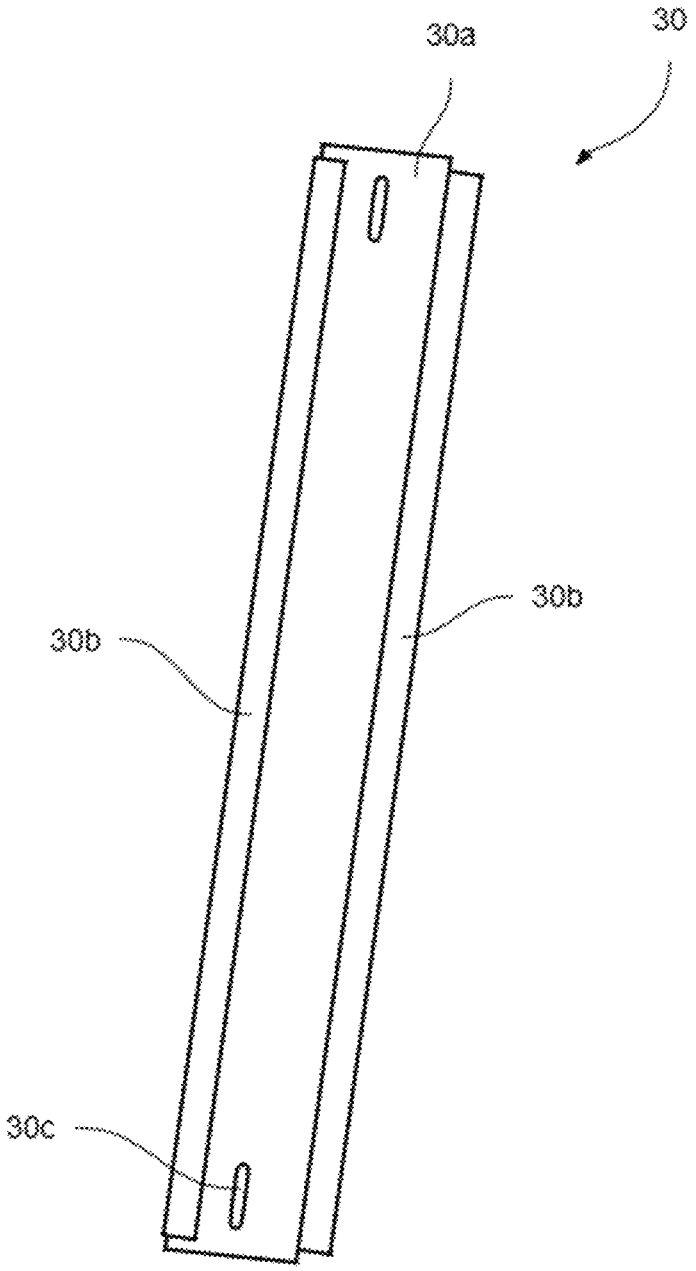
FIG. 6 illustrates an isometric view of the side cover of FIG. 2*a*, wherein a single continuous, elongated tab is configured on at least one of the opposite sides of the side panel.

In accordance with an embodiment, the side panel 30*a* includes a plurality of tabs 30*b* configured on at least one of the opposite sides thereof. The tabs 30*b* are spaced away from each other with gap in between adjacent tabs 30*b*. In another example, the side panel 30*a* includes a single continuous tab 30*b* configured on at least one of the opposite sides of the side panel 30*a*, as shown in FIG. 6. The tabs are capable of covering at least a portion of the heat exchanger core 20 disposed between the tubular element 20*a* proximal to the lateral face of the heat exchanger core 20 and the at least one corresponding side cover 30.

Several modifications and improvement might be applied by the person skilled in the art to the heat exchanger as disclosed above and such modifications and improvements will still be considered within the scope and ambit of the present invention, as long as the heat exchanger includes a tank, spaced apart tubular elements, fins and a side cover.

The tank receives a first heat exchange fluid therein. The spaced apart tubular elements defining a heat exchanger core are in fluid communication with the tank and enable heat exchange between a first heat exchange fluid flowing there through and a second heat exchange fluid flowing around and across the tubular elements. The plurality of fins and the tubular elements are arranged alternately with respect to each other. The fins promote heat exchange between the first heat exchange fluid and the second heat exchange fluid. The first and the last of the fins constituting respective opposite lateral faces of the core. The side cover is adjacent to a lateral face of the core. The side cover covers and shields the corresponding lateral face of the heat exchanger core and at least a portion of the heat exchanger core disposed between the tubular elements proximal to the lateral face of the heat exchanger core and the corresponding side cover.

What is claimed is:

1. A heat exchanger comprising:

a tank adapted to receive a first heat exchange fluid therein;

a plurality of spaced apart tubular elements defining a heat exchanger core, adapted to be in fluid communication with the tank and enable heat exchange between a first heat exchange fluid flowing there through and a second heat exchange fluid flowing around and across the plurality of spaced apart tubular elements;

a plurality of fins arranged alternately with the tubular elements, the fins being adapted to promote heat exchange between the first heat exchange fluid and the second heat exchange fluid, the first and the last of the fins constituting respectively opposite lateral faces of the heat exchanger core;

a side cover adjacent to a lateral face of the core;

wherein the side cover is adapted to cover the corresponding lateral face of the heat exchanger core and at least a portion of the heat exchanger core disposed between the tubular element proximal to the lateral face of the heat exchanger core and the corresponding side cover, wherein the side cover includes:

a side panel complimentary to and aligned with respect to a corresponding lateral face of the heat exchanger core; and a plurality of tabs configured on at least one of the opposite lateral sides of the side panel, the plurality of tabs being orthogonal to the side panel and adapted to cover at least a portion of the fins disposed between the tubular element proximal to the lateral face of the heat exchanger core and the corresponding side panel, the plurality of tabs being configured on at least one of the opposite sides of the side panel and being spaced away from each other by gaps in between the adjacent tabs, wherein tabs of the plurality of tabs that are formed on extreme ends of the side panel are abutting the respective tank, wherein the tank is wider than the side cover, the side cover being wider than the heat exchanger core and accommodating an insulating material between the side cover and the heat exchanger core.

2. The heat exchanger as claimed in claim 1, wherein a single continuous, elongated tab is configured on at least one of the opposite sides of the side panel.

3. The heat exchanger as claimed in claim 1, wherein the tabs extend from the side panel at least up to the tubular element proximal to the corresponding lateral face of the heat exchanger core.

4. The heat exchanger as claimed in claim 1, wherein the tabs extend from the side panel and beyond the tubular element proximal to the corresponding lateral face of the heat exchanger core.

5. The heat exchanger as claimed in claim 1, wherein the side cover is of metal and is formed by stamping and bending.

6. The heat exchanger as claimed in claim 1, wherein the side cover is of aluminum and is directly brazed to the fins.

7. The heat exchanger as claimed in claim 1, wherein the tubular element proximal to the lateral face of the heat exchanger core and the corresponding side cover is spaced less than or equal to pitch of the plurality of spaced apart tubular elements.

8. The heat exchanger as claimed in claim 1, the tank including a corresponding header for the plurality of spaced apart tubular elements, wherein the side panel is overlapping the corresponding header.

9. The heat exchanger as claimed in claim 1, wherein the side cover is of plastic and is formed by molding.

10. The heat exchanger as claimed in claim 1, wherein the side cover is permanently secured to the heat exchanger core.

11. The heat exchanger as claimed in claim 1, wherein the side cover is removably mounted on the heat exchanger core.

* * * * *